US006702115B1

(12) United States Patent
Roper

(10) Patent No.: US 6,702,115 B1
(45) Date of Patent: Mar. 9, 2004

(54) PACKAGING ARRANGEMENT

(75) Inventor: Andrew Roper, Highgate (AU)

(73) Assignee: Skypak International PTY LTD, Alelaide (AU)

( * ) Notice: Subject to any disclaimer, the term of this patent is extended or adjusted under 35 U.S.C. 154(b) by 0 days.

(21) Appl. No.: 09/913,811

(22) PCT Filed: Jul. 30, 1999

(86) PCT No.: PCT/AU99/00612

§ 371 (c)(1),
(2), (4) Date: Jan. 7, 2003

(87) PCT Pub. No.: WO00/48918

PCT Pub. Date: Aug. 24, 2000

(Under 37 CFR 1.47)

(30) Foreign Application Priority Data

Feb. 19, 1999 (AU) ..... PP8767

(51) Int. Cl.[7] ..... B65D 65/00
(52) U.S. Cl. ..... 206/427; 206/433; 206/485
(58) Field of Search ..... 206/139, 427, 206/431, 433, 485, 486; 229/120.32, 120.33, 120.38

(56) References Cited

U.S. PATENT DOCUMENTS 1,803,028 A * 4/1931 Menten ..... 206/485
1,826,104 A * 10/1931 Van Cleaf ..... 206/427
3,115,247 A * 12/1963 Hauser ..... 206/485
3,297,191 A * 1/1967 Eastman ..... 206/427
3,868,140 A 2/1975 Gordon
4,394,905 A * 7/1983 Hackenberg ..... 206/486
4,911,300 A * 3/1990 Colonna ..... 206/427
5,323,895 A 6/1994 Sutherland et al.
5,845,776 A * 12/1998 Galbierz et al. ..... 206/427

FOREIGN PATENT DOCUMENTS

DE 29621264 U1 3/1997
GB 2154197 A 9/1985

* cited by examiner

*Primary Examiner*—Luan K. Bui
(74) *Attorney, Agent, or Firm*—J. Herbert O'Toole; Nexsen Pruet, LLC

(57) ABSTRACT

A packaging arrangement, the arrangement characterized by: an outer carton (12); a plurality of supporting inserts (14, 16, 18) within the carton, the inserts being supported against inner walls of the carton, the inserts being maintained in a spaced apart relationship with one another and having one or more passage means therein (20, 22, 30) each passage means being adapted to provide support for articles held in the packaging arrangement and one or more of the inserts (14, 16) being adapted to hold and provide support for articles of different dimensions.

7 Claims, 6 Drawing Sheets

PACKAGING ARRANGEMENT

FIELD OF THE INVENTION

The present invention relates to a packaging arrangement useful in the transportation of glass, and other delicate containers. In particular the packaging arrangement of the present invention finds application in the packaging for transport of wine bottles.

BACKGROUND OF THE INVENTION

The transport of glass bottles or containers containing liquids poses well known problems. Such containers are relatively heavy and susceptible to breakage. To overcome the problems associated with the delicacy of glass a number of packaging solutions have been devised. In the case of wine, cases of 12 bottles in cardboard cartons can be transported. Typically a flimsy card web will be placed between neighbouring bottles to ensure that they do not damage one another. Alternatively, expanded polystyrene packaging has been used for bottles.

In the situation where cardboard carton are used to transport bottles it is the experience of the inventor that the packaging is inadequate in a number of situations and that breakages occur all too readily. A breakage is not only a costly exercise for the owner of the product but is also undesirable from the point of view of those transporting the product. Polystyrene is also undesirable from an environmental perspective and, in some areas of the world, the environmental undesirability of the material is likely to result in an increased material cost as a result of government taxes or levies imposed on such materials.

Specific difficulties arise in the transport of small quantities of wines. The products are typically of high value and mixed selections are often packaged together for transport. Thus packaging has to be adapted to take bottles of varying sizes and to be able to protect them from injury.

The present invention is addressed to this situation and is directed to a packaging arrangement suitable for use with bottles and like containers that provides support against movement during transport for these containers. The packaging arrangement has also been designed to take into account the need to minimise space and weight occupied by items to be transported, whilst being able to be manufactured from materials such as cardboard.

SUMMARY OF THE INVENTION

Therefore, according to a first aspect of the present invention there is provided a packaging arrangement for use in the packaging of bottles, the arrangement including an outer carton;

a plurality of supporting inserts within the carton, the inserts being supported against inner walls of the carton, the inserts being vertically spaced from each other and having one or more passage means therein, each passage means being adapted to provide support for articles held in the packaging arrangement and one or more of the inserts being adapted to hold and provide support for articles of different dimensions.

Preferably, the inserts are able to be manufactured from a foldable cardboard blank.

Thus, the carton of the present invention provides a plurality of separate inserts each of which supports a the article. By maintaining a vertically spaced arrangement the inserts can provide support for articles held in the carton at spaced apart points on the article. In the case of a wine bottle the inserts provide support against excessive movement along the length of the bottle. Importantly, the packaging arrangement also includes one or more inserts which are adapted for use with articles of different sizes. It is common for bottles to be transported in groups and in some cases in mixed groups. In these situations the inserts of the invention can be used to support several different shapes of bottle, for example the one carton may contain 'Chardonnay' type bottles, together with 'burgundy' type bottles and so on.

The ability to adapt to differently sized articles whilst maintaining support for those articles is can be achieved by including in the inserts a plurality of tab portions which extend into the passages and which have associated lines of weakness in the insert extending there from. Thus, the passage can be manufactured to a predetermined minimum size and, where an oversize or larger article is placed in the passage the tab portions are deflected to allow the article through the passage but coontie to provide support for the article.

In the case of wine bottles, such deflecting tabs can be provided in those inserts which would support the body of the bottle, that is where the bulk of the bottle is located.

Preferably, the packaging arrangement is provided with means to maintain the inserts in a spaced apart relation.

Advantageously, a packaging arrangement in accordance with the invention for a plurality of wine bottles might include:

an outer carton;

a first, lowermost insert consisting of a foldable cardboard blank, which folds to produce a structure having a pair of parallel channels, an uppermost surface of each channel including three cut out apertures adapted to receive a wine bottle body therein, the cut out apertures each having a plurality of tab portions which extend into the passages and which have associated lines of weakness extending into the insert therefrom, the cut out portions serving to bear against and support each bottle therein and being able to deflect to receive bottles of larger diameter;

a centre insert consisting of a foldable cardboard blank, which folds to produce a structure having a pair of parallel channels, one surface of each channel including three cut out apertures, the cut out apertures each having a plurality of tab portions which extend into the passages and which have associated lines of weakness extending into the insert therefrom, the cut out portions serving to bear against and support each bottle therein and being able to deflect to receive bottles of larger diameter, each cut out aperture having a respective bottle neck locating aperture on an opposing surface of the channel, and an uppermost insert consisting of a foldable cardboard blank, which folds to produce a structure having a pair of parallel channels each channel including three cut out apertures serving as bottle neck locating apertures;

wherein the inserts are arranged such that each of the three cut out apertures adapted to receive a wine bottle body therein in the lowermost and centre inserts are placed opposing one another and each of the bottle neck locating apertures in the centre and uppermost inserts are placed opposing one another.

Conveniently, in such an arrangement the lowermost and centre inserts may share a common geometry but be placed in mirror image positions in use.

BRIEF DESCRIPTION OF THE DRAWINGS

The present invention will now be described by way of the example as illustrated in the accompanying drawings in which.

DESCRIPTION OF THE PREFERRED EMBODIMENT

Figure 1:
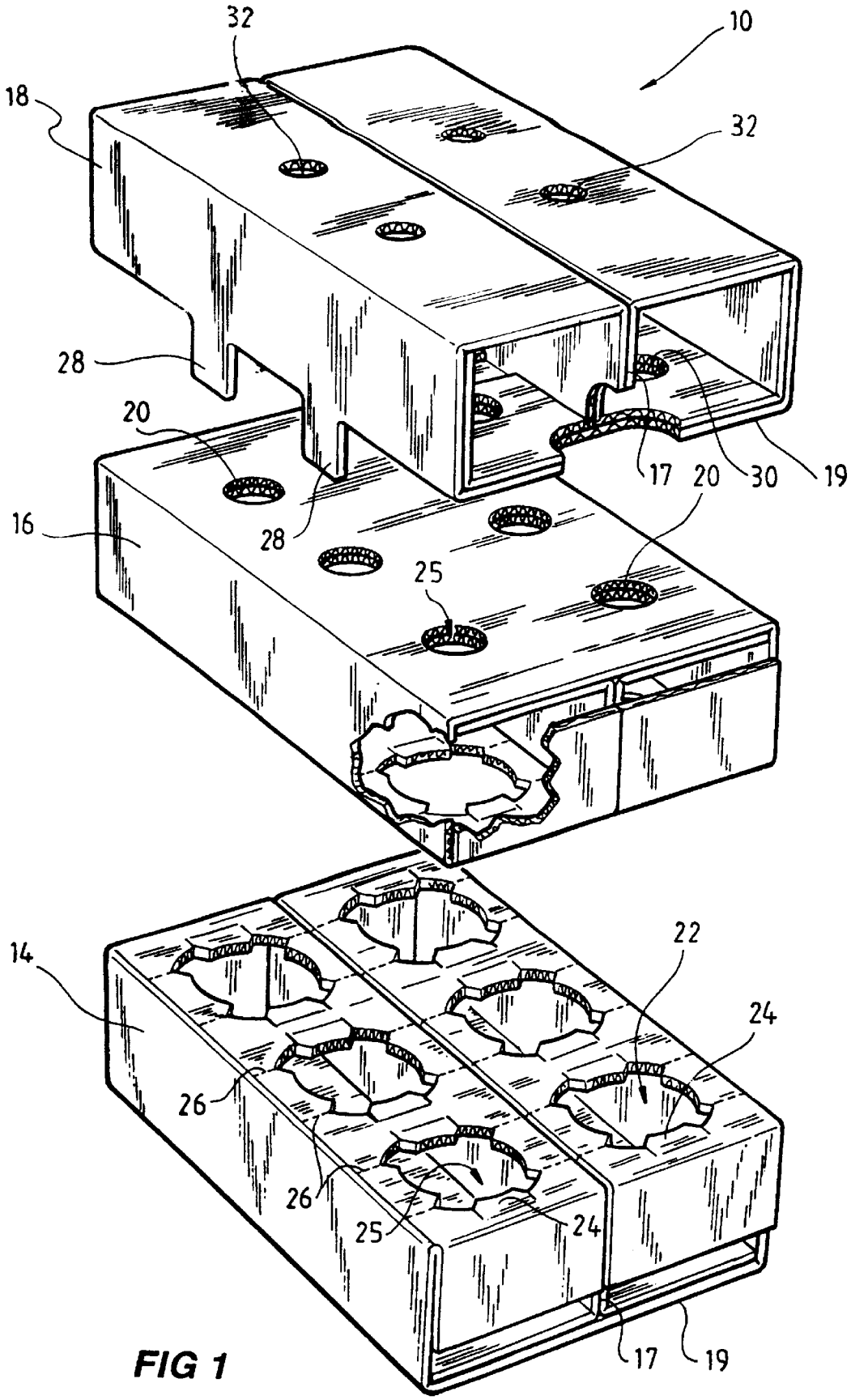
FIG. 1 represents a perspective view of a packaging arrangement in accordance with a first aspect of the present invention.
Figure 2:
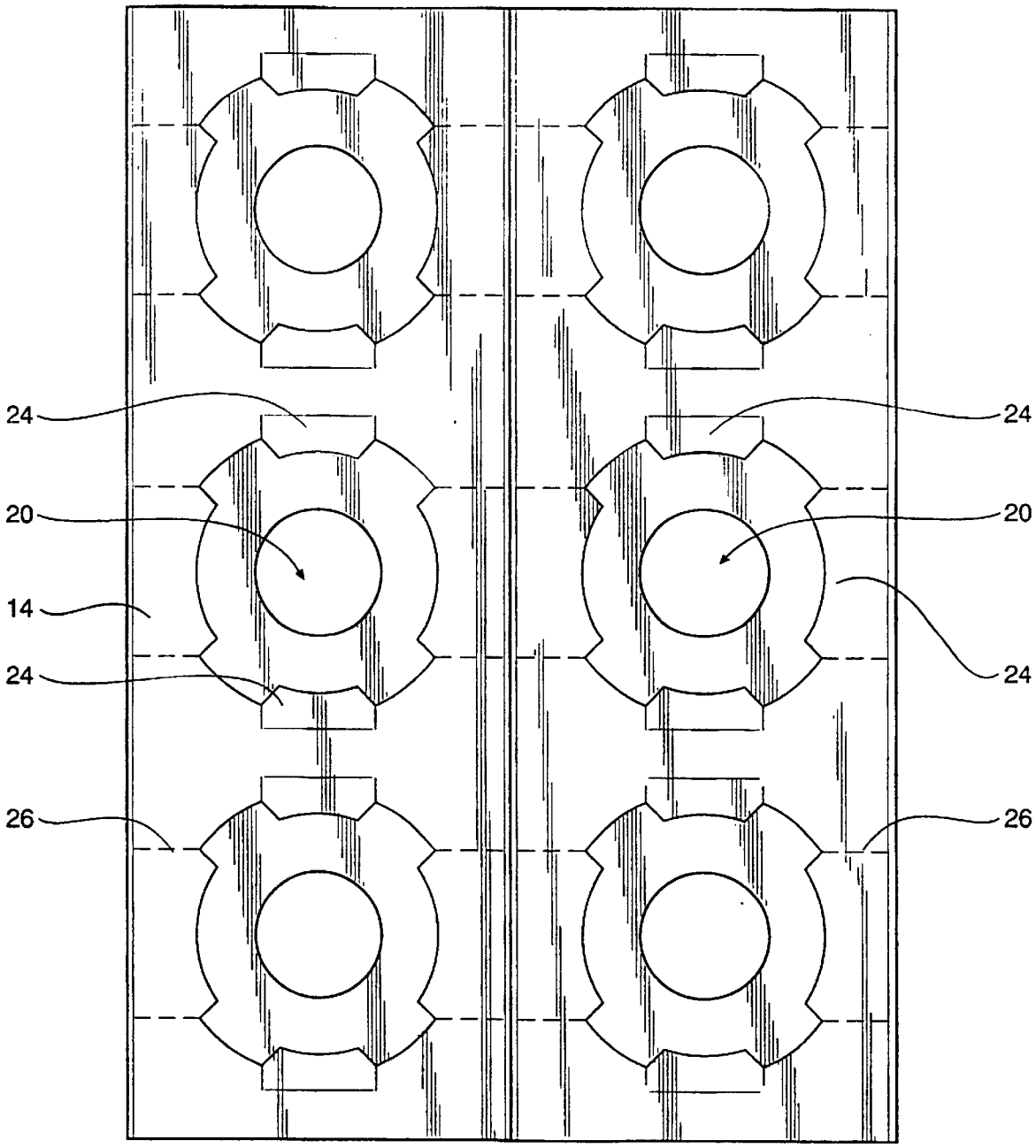
FIG. 2 illustrates the in plan view and in side cross-sectional view one section of the arrangement of FIG. 1.
Figure 3:
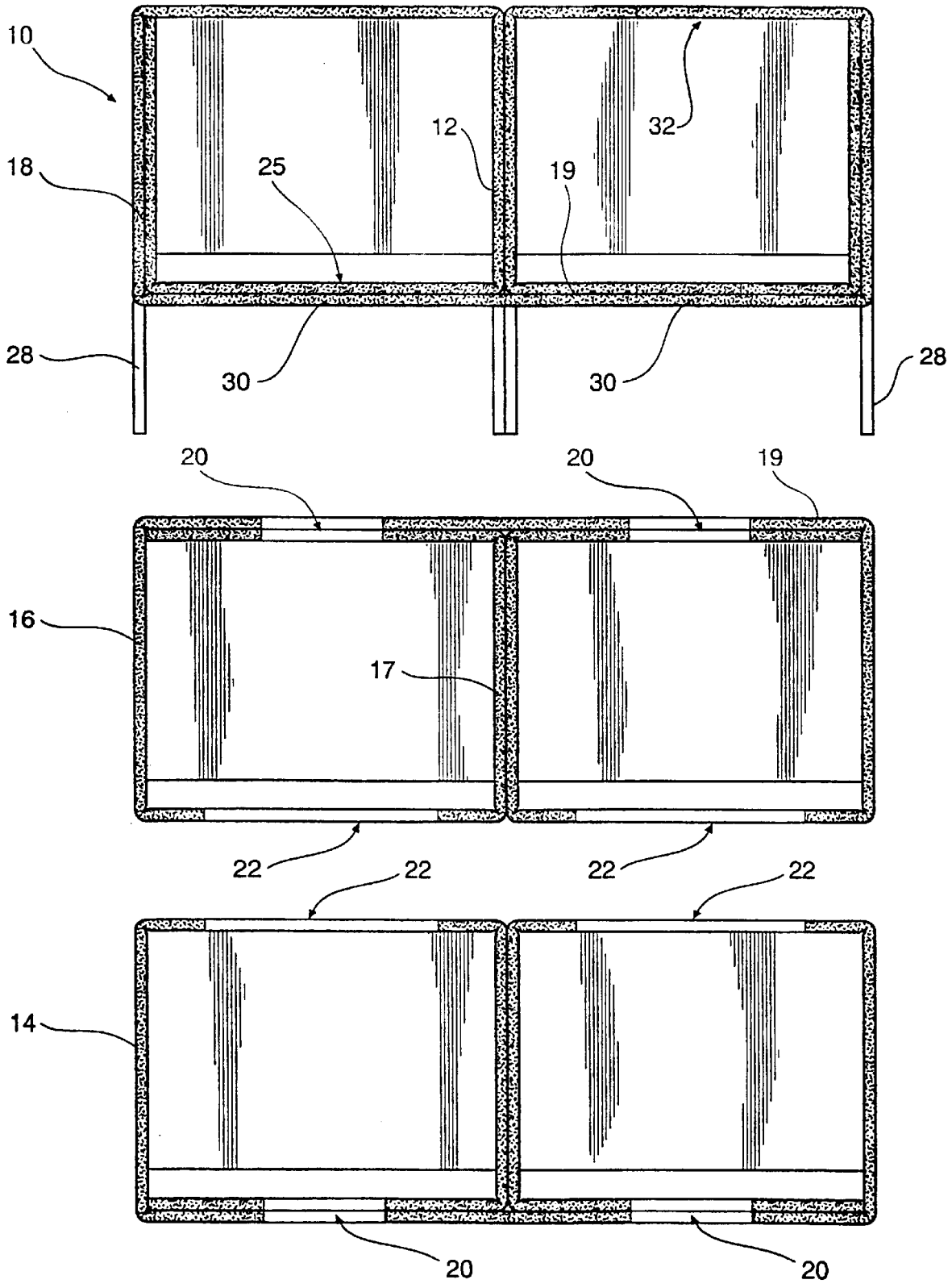
FIG. 3 illustrates a cross-sectional side view of the packaging arrangement of FIG. 1.
Figure 4:
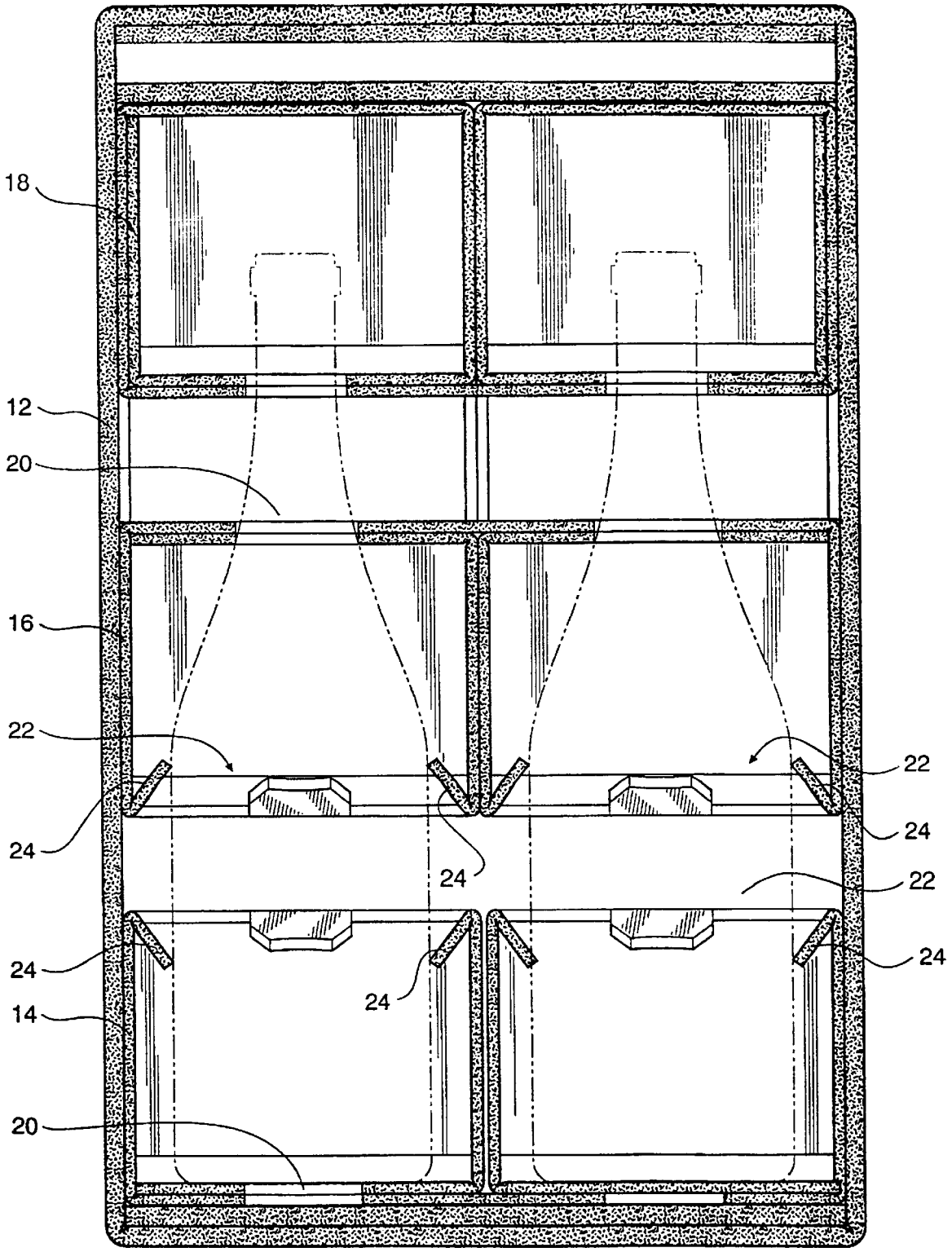
FIG. 4 represents a first cross-sectional view of a carton including a packaging arrangement as shown in FIG. 1 used for packaging wine bottles of a first size.
Figure 5:
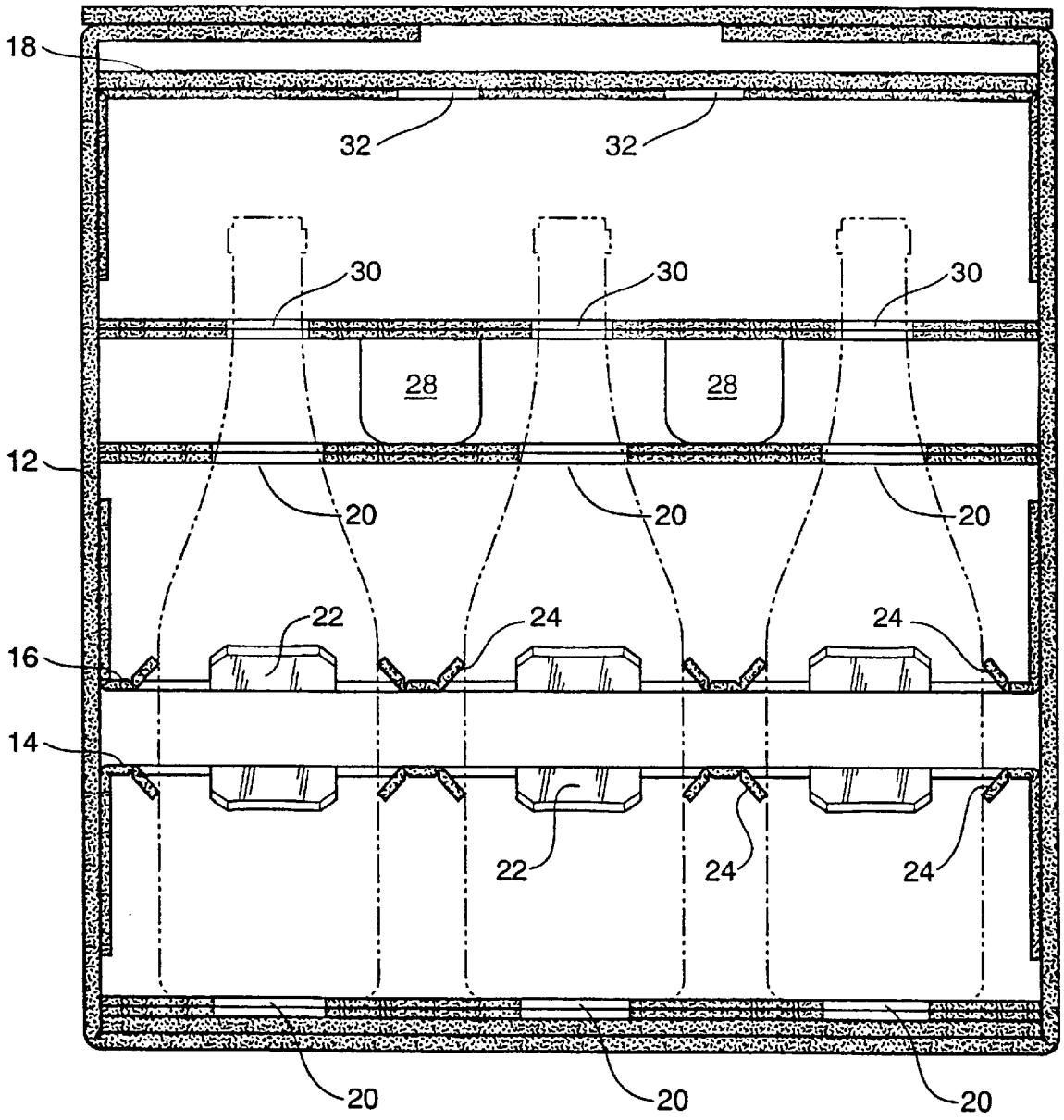
FIG. 5 illustrates a second cross-sectional side view of the carton and packaging arrangement of FIG. 4.
Figure 6:
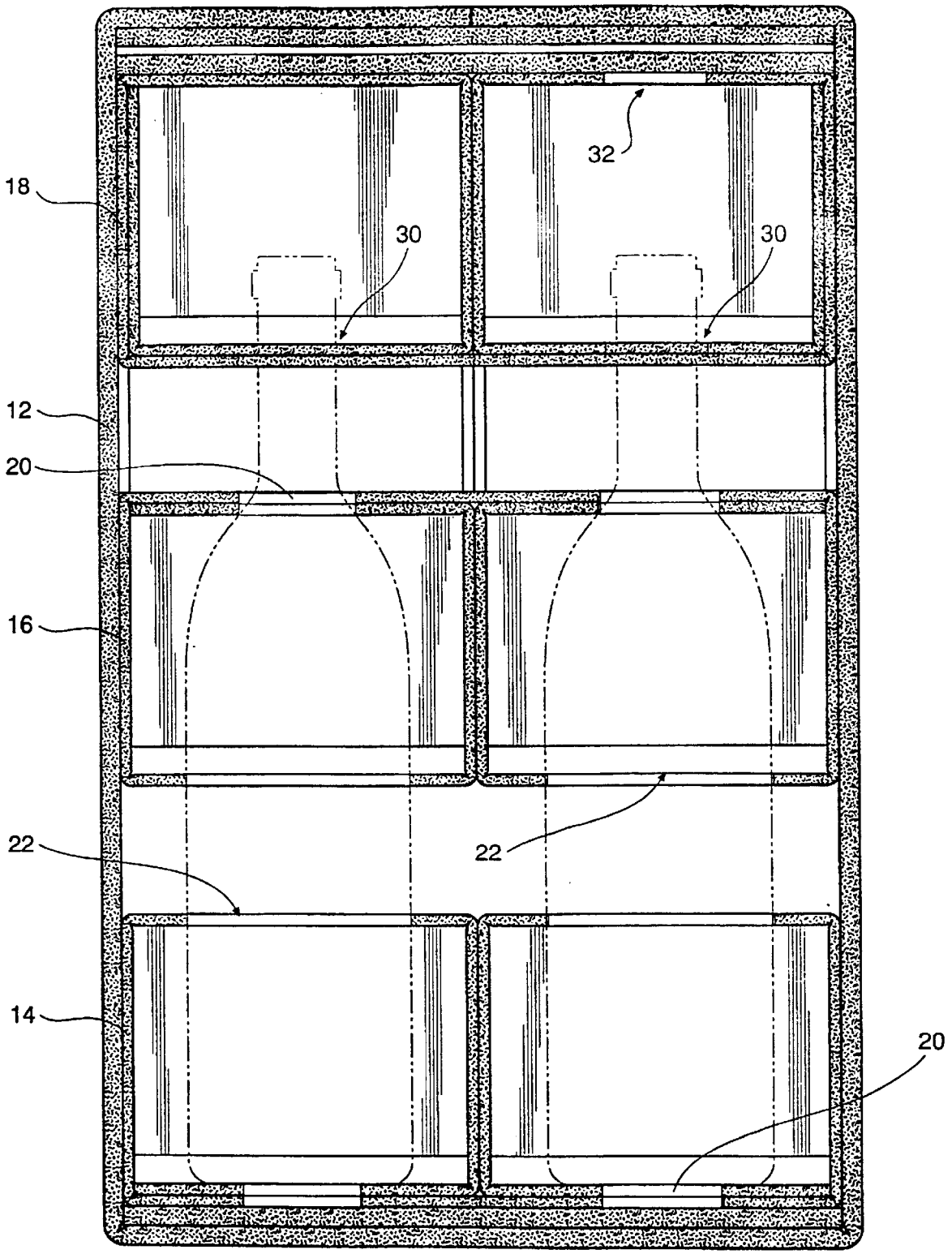
FIG. 6 shows the carton and packaging arrangement of FIG. 4 used for packaging wine bottles of a second size.

Shown in FIGS. 1, 2 and 3 is a packaging insert 10 formed in accordance with the present invention. In FIGS. 4, 5 and 6 the insert 10 is shown in an outer carton 12 housing various wine bottles.

The packaging insert arrangements 10 comprises three inserts, a lower most insert 14, a centre insert 16 and an uppermost insert 18. By careful inspection of the drawings it can be seen that the centre insert 16 and the lower most insert 14 share a common geometry and are simply placed in mirror image positions. For the sake of convenience like numerals will be used to indicate like parts in respect of these items.

From inspection of FIGS. 4, 5 and 6 it can also be seen that the inserts 14, 16 and 18 are a close fit within the outer carton 12. In the particular embodiment described the package as a whole is designed for transport of six wine bottles. It will be appreciated that the invention is not to be limited to any package of this particular size or arrangement of articles to be carried. The invention embraces within its scope an infinite variety of potential geometries and arrangement of packaging. Specifically, the packaging insert of the present invention is readily adapted for the packaging of smaller numbers of bottles or, of single bottles.

Each of the inserts 14, 16 and 18 are formed from foldable cardboard blanks. Apertures at appropriate points are cut in the cardboard blanks to form various cut out sections of the inserts. The lowermost and centre inserts 14 and 16 are each folded to form a pair of parallel channels extending generally horizontally. A cardboard blank is folded so as to produce the four sided channels with a double interior 17 wall and one generally horizontal surface having a double layer 19. In the case of the lowermost insert 14 this double layer 19 is formed on the base of the channel, whereas in the centre most insert 16 the double layer is positioned so as to be the upper surface of the insert, as can be seen in FIG. 3.

A series of first apertures are provided in the cardboard blank so as to produce an array of six apertures 20 which appear in the base of the lowermost insert 14 and in the upper surface of the centre insert 16. The first apertures 20 serve in the centre most insert as bottle locating apertures as can be seen in FIGS. 4, 5 and 6. The first apertures 20 are relatively small and are sized to fit comfortably around the neck of all commonly used wine bottle types.

On that portion of the foldable cardboard blank forming the upper most surface of the insert 14, and the lower most surface of the centre insert 16, a further series of second apertures have been cut. These larger, second apertures, 22 are shaped so as to be able to receive the body portion of a wine bottle, as shown in FIG. 6. In the folded position illustrated in FIG. 1 the first and second apertures 20,22 are coincident. Moreover, as the lowermost insert 14 and the centre insert 16 are mirror images the second apertures of each insert are arranged opposing each other in a spaced apart arrangement on the bottle.

Each second aperture 22 further include tab portions 24 which extend into the aperture 22. Extending from corners of the tab portions 24 into the body of the insert 14, 16 are lines of weakness 26. The lines of weakness 26 enable the tab portions 24 to be deflected when the need arises such that the apertures 22 are able to receive wine bottles of a wider diameter for example as shown in FIG. 4. As the tab portions 24 are deflected, the aperture 22 maintains contact with any bottle inserted into the aperture, such that the position of the bottle is maintained.

The apertures 20 and 22 provide together a passage 25 extending through the arrangement of inserts into which a bottle can be received.

The tab portions 24 further provide, to some extent at least a mechanism to absorb any excessive movement which might otherwise be transmitted to the bottle. It is also important to note that the support provided to the bottle by the apertures 22 and tab portions 24 occurs both in the lowermost insert 14 and also in the centre insert 16, that is the bottle is supported at various points along its length.

The uppermost insert 18 also consists of a cardboard blank folded in to form two parallel channel sections. A lowermost surface of the insert 18 includes downwardly extending spacers 28 which serve to maintain a space between the centre insert 16 and the uppermost insert 18 in use. In addition, a lower most surface of the insert 18 includes a number of apertures 30 which are secured around bottle necks in use as shown in FIGS. 4, 5 and 6. As a matter of convenience an uppermost surface of the insert 18 includes a number of further apertures 32 which can be used as finger holes for inserting and removing the insert 18.

In use, the packaging arrangement is assembled in the following manner. Firstly, the outer carton is opened, and if necessary any liners or spacing materials are placed therein. The lowermost insert is then inserted with the apertures 22 facing upwardly. At this point any bottles to be transported in the package are inserted. As has been explained bottles of different sizes can be placed in the same package. The tab portions 24 are deflected when the bottles are inserted.

The centre most insert 16 is then placed over the bottles, again with the tab portions 24 being deflected to support the bottles. The centre most insert 16 is maintained in a spaced apart relationship with the lowermost insert 14 by a combination of the insert 16 being located on the bottle by the tab portions 24 bearing against the bottle and also by the fact that the apertures 20 around the bottle neck prevent the insert 16 from sliding further down the body of the bottle.

Finally, the uppermost insert 18 is placed over the bottles, the tab portions 28 serving to maintain a distance between the centre most insert 16 and the uppermost insert 18.

It is thought that the centre most insert 16 provides high degree of the protection provided by the present invention in its support against movement during transportation of bottles and like containers. This insert fits about the body of the bottle and the junction of the neck to the body of the bottle. This can act to secure the bottle in a fixed position relative to the sides of the carton. The uppermost and lowermost inserts when positioned about the bottle can act to secure the middlemost insert into a fixed position relative to the uppermost and lowermost inserts, and thereby assist in preventing movement of the bottle towards the top or the bottom of the carton.

The carton 12 can be sealed. The carton 12 is then ready for transporting. As shown in FIG. 5 it is clear that the inserts co-operate together to support the bottle against movement in three dimensions by supporting the bottle at several points around As circumference and at several points along its length.

Modifications and variations of the present invention such as would be apparent to a skilled addressee are deemed to be within the scope of the invention.

What is claimed is:

1. A packaging arrangement, the arrangement characterized by an outer carton (12);

a plurality of supporting inserts (14, 16, 18) within the carton, the inserts being supported against inner walls of the carton, the inserts being maintained in spaced apart relationship with one another and having one or more passage means therein (20,22,30) each passage means being adapted to provide support for articles held in the packaging arrangement and one or more of the inserts (14,16) being adapted to hold and provide support for articles of different dimensions, wherein at least one of the inserts includes tab portion (24) adapted extending into the passage means to resiliently bear against articles located therein, and further characterized in that the tab portions are deflectable to adapt for use with articles of different sizes, and further characterized in that the tab portions which extend into the passages and which have associated lines of weakness (26) in the insert extending into a body of the insert therefrom, said lines of weakness (26) allowing oversize articles to be accommodated into the passage means.

2. A packaging arrangement according to claim 1 further characterized in that, the inserts are able to be manufactured from a foldable cardboard blank.

3. A packaging arrangement according to claim 1, further characterized in that at least on of the inserts includes one or more spaces (28) adapted to maintain a spaced apart arrangement between adjacent inserts.

4. A packaging arrangement, the arrangement being characterized by:

an outer carton at least one first insert (14,16) consisting of a foldable cardboard blank, which folds to produce a structure having a pair of parallel channels, one surface of each channel including a plurality of first apertures (22), the first apertures each having a plurality of tab portions (24) which extend into the passages (25) and which have associated lines of weakness (26) extending into the insert an article therein and being able to deflect to receive articles of larger diameter, each cut out aperture having a respective second aperture (22) on an opposing surface of this channel, and at least one second insert (18) consisting of a foldable cardboard blank which folds to produce a structure having a pair of parallel channels each channel including a plurality of apertures (30) serving locating apertures;

wherein the inserts are arranged in the carton such that each of the first apertures and second in the first insert and the locating apertures in the second insert are aligned.

5. A packaging arrangement adapted for the packaging of one or more bottles, characterized in that the arrangement includes:

an outer carton (12);

a first, lowermost insert (14) consisting of a foldable cardboard blank, which folds to produce a structure having a pair of parallel channels, an uppermost surface of each channel including three cut out apertures (22) forming a passage adapted to receive a wine bottle body therein, the cut out apertures each having a plurality of tab portions (24) which extend into the passages (25) and which have associated lines of weakness (26) extending into the insert therefrom, the cut out portions serving to bear against and support each bottle therein and being able to deflect to receive bottles of larger diameter;

a center insert (16) consisting of a foldable cardboard blank, which folds to produce a structure having a pair of parallel channels, one surface of each channel including three cut out apertures (22), the cut out apertures each having a plurality of tab portions (24) which extend into the passages (25) and which have associated lines of weakness (26) extending into the insert therefrom, the cut out portions serving to bear against and support each bottle therein and being able to deflect to receive bottles of larger diameter, each cut out aperture having a respective bottle neck locating aperture (22) on an opposing surface of the channel; and an uppermost insert (18) consisting of a foldable cardboard blank, which folds to produce a structure having a pair of parallel channels each channel including three cut out apertures (30) serving as bottle neck locating apertures;

wherein the inserts are arranged such that each of the three cut out apertures adapted to receive a wine bottle body therein in the lowermost and center inserts are placed opposing each other and each of the bottle neck locating apertures in the center and uppermost inserts are placed opposing one another.

6. A packaging arrangement according to claim 5, wherein the lowermost and center inserts are identical and are arranged in mirror image positions.

7. A packaging arrangement according to claim 5 for the packaging of one bottle.

* * * * *